US007596493B2

(12) United States Patent
Singh et al.

(10) Patent No.: US 7,596,493 B2
(45) Date of Patent: Sep. 29, 2009

(54) SYSTEM AND METHOD FOR SUPPORTING MULTIPLE SPEECH CODECS

(75) Inventors: Ravindra Singh, Singapore (SG); Anoop K. Krishna, Singapore (SG)

(73) Assignee: STMicroelectronics Asia Pacific Pte Ltd., Singapore (SG)

( * ) Notice: Subject to any disclaimer, the term of this patent is extended or adjusted under 35 U.S.C. 154(b) by 506 days.

(21) Appl. No.: 11/312,005

(22) Filed: Dec. 19, 2005

(65) Prior Publication Data

US 2006/0149540 A1 Jul. 6, 2006

(30) Foreign Application Priority Data

Dec. 31, 2004 (SG) ..... 200407882-0

(51) Int. Cl.
*G10L 19/12* (2006.01)
*G10L 19/00* (2006.01)

(52) U.S. Cl. ..... 704/223; 704/220; 704/221

(58) Field of Classification Search ..... None
See application file for complete search history.

(56) References Cited

U.S. PATENT DOCUMENTS

| | | | | |
|---|---|---|---|---|
| 5,444,816 | A | 8/1995 | Adoul et al. | |
| 5,701,392 | A | 12/1997 | Adoul et al. | |
| 5,717,825 | A | 2/1998 | Lamblin | |
| 6,556,966 | B1 * | 4/2003 | Gao | 704/220 |
| 6,691,082 | B1 * | 2/2004 | Aguilar et al. | 704/219 |
| 6,728,669 | B1 * | 4/2004 | Benno | 704/219 |
| 6,738,733 | B1 * | 5/2004 | Tian | 702/189 |
| 7,302,387 | B2 * | 11/2007 | Li et al. | 704/223 |
| 2004/0181400 | A1 * | 9/2004 | Kannan et al. | 704/223 |
| 2005/0049855 | A1 * | 3/2005 | Chong-White et al. | 704/219 |

OTHER PUBLICATIONS

Jung, S. Kim, K. Kang, H. Youn, D. "A cascaded algebraic codebook structure to improve the performance of speech coder", IEEE Conference on Acoustics, Speech and Signal Processing, Apr. 2003.*
International Telecommunication Union, "Coding of Speech at 8 kbit/s Using Conjugate-Structure Algebraic-Code-Excited Linear-Prediction (CS-ACELP)", ITU-T Recommendation G.729, Geneva, Mar. 1996, 38 pages.

(Continued)

*Primary Examiner*—Matthew J Sked
(74) *Attorney, Agent, or Firm*—Lisa X. Jorgenson; William A. Munck

(57) ABSTRACT

A method for performing a search of a codebook is provided. The codebook includes a plurality of tracks each having a plurality of even pulse positions. The method includes partitioning a codevector having a plurality of pulses into a first subset of pulses and a second subset of pulses. Each pulse is assignable to a pulse position in the codevector, and each pulse is associated with a shift bit for indicating an odd position. The method also includes performing a first search for determining a first set of possible pulse positions for the pulses in the codevector. The method further includes performing a second search for determining a second set of possible pulse positions for the pulses in the codevector. In addition, the method includes forming the codevector using the first and second sets of possible pulse positions.

20 Claims, 10 Drawing Sheets

OTHER PUBLICATIONS

International Telecommunication Union, "Reduced Complexity 8 kbit/s CS-ACELP Speech Codec", ITU-T Recommendation G.729 Annex A, Nov. 1996, 15 pages.

Shridhar Mubaraq Mishra et al., "Efficient Hardware-Software Co-Design for the G.723.1 Algorithm Targeted at VoIP Applications", 2000 IEEE, pp. 1379-1382.

Andreas S. Spanias, "Speech Coding: A Tutorial Review", Proceedings of the IEEE, vol. 82, No. 10, Oct. 1994, pp. 1541-1582.

Christian Plessl et al., "Hardware/Softeware Codesign in Speech Compression Applications", Feb. 9, 2000, Swiss Federal Institute of Technology Zurich, Term Thesis WS 99/00 SA-2000.14, 43 pages.

Vassilios A. Chouliaras et al., "Scalar Coprocessors for Accelerating the G723.1 and G729A Speech Coders", 2003 IEEE, pp. 703-710.

Sang-Min Lee et al., "Cost-Effective Implementation of ITU-T G.723.1 on a DSP Chip", IEEE 1997, pp. 31-34.

A.Z.R. Langi, "A DSP Implementation of a Voice Transcoder for VOIP Gateways", 2002 IEEE, pp. 181-186.

Allen Gersho, "Advances in Speech and Audio Compression", Proceedings of the IEEE, vol. 82, No. 6, Jun. 1994, pp. 900-907.

International Telecommunication Union, "Perceptual Evaluation of Speech Quality (PESQ): An Objective Method for End-To-End Speech Quality Assessment of Narrow-Band Telephone Networks and Speech Codecs", ITU-T Recommendation P.862, Feb. 2001, 30 pages.

Sung Wan Yoon et al., "An Efficient Transcoding Algorithm for G.723.1 and G.729A Speech Coders", Eurospeech 2001-Scandinavia, vol. 4, pp. 2499-2502.

Redwan Salami et al., "ITU-T G.729 Annex A: Reduced Complexity 8 kb/s CS-ACELP Codec for Digital Simultaneous Voice and Data", IEEE Communications Magazine, IEEE Service Center, New York, NY, US, vol. 35, No. 9, Sep. 1997, pp. 56-63.

Huijuan Cui et al., "Audio as a Support to Low Bitrate Multimedia Communication", Proceedings of the International Conference on Communication Technology, vol. 1, Oct. 22, 1998, pp. 544-547.

International Telecommunication Union, "Dual Rate Speech Coder for Multimedia Communications Transmitting at 5.3 and 6.3 kbit/s", ITU-T Recommendations, Geneva, CH, Mar. 1996, pp. I-IV,1.

* cited by examiner

SYSTEM AND METHOD FOR SUPPORTING MULTIPLE SPEECH CODECS

CROSS-REFERENCE TO RELATED APPLICATIONS

This application claims priority under 35 U.S.C. § 119 to Singapore Patent Application No. 200407882-0 filed on Dec. 31, 2004, which is hereby incorporated by reference.

TECHNICAL FIELD

This disclosure relates generally to communication systems and more specifically to a system and method for supporting multiple speech codecs.

BACKGROUND

Speech coders and decoders, often referred to collectively as "codecs," are routinely used in communication systems to encode and decode speech signals. In general, codecs are often implemented in software executed by a digital signal processor (DSP). Different codecs often require different processing times, depending on their complexities and the speed of the processor.

Speech codecs that are widely used in various applications include the International Telecommunication Union-Telecommunications (ITU-T) G.723.1 and G.729A codecs. These are complex codecs that usually require large amounts of processing time and memory. Speech coders for both codecs use Algebraic-Code-Excited Linear-Prediction (ACELP), which is based on the Code-Excited Linear-Prediction (CELP) coding model.

Products used in many communication systems often need to support multiple speech codecs, such as in Digital Simultaneous Voice and Data (DSVD) systems and Voice over Internet Protocol (VoIP) systems. Products such as gateway applications also often need to support multiple channels. Large amounts of processing power and memory are typically needed in these products.

FIG. 1 illustrates a conventional ACELP encoder 100. The functional blocks in the ACELP encoder 100 that typically consume the highest proportion of processing power and memory are a Linear Predictive Coding (LPC) analysis block 102, an adaptive codebook search block 104, and a fixed codebook search block 106. Implementing these three functional blocks 102-106 on a co-processor could allow the processing capacity of the DSP to be used for other computations and functions. However, the disparity between different speech codecs often requires that each codec be implemented on a separate co-processor. As a result, supporting multiple codecs would typically require the use of multiple co-processors.

Also, the fixed codebook search algorithms for the G.723.1 (5.3 kbps) and G.729A codecs are based on algebraic codebook searches. Implementing fixed codebook searches for both codecs on a single co-processor could reduce the complexity of the system. This could also allow unused processing power and memory of the DSP to be used for other functions, such as supporting multiple channels and other application-specific modules. However, fixed codebook searches for the G.729A codec use a "depth-first tree search" algorithm, while fixed codebook searches for the G.723.1 codec use a "nested-loop search" or a "focused nested-loop search" algorithm. The "focused nested-loop search" and the "depth-first tree search" algorithms are distinctly different. Attempting to implement these two fixed codebook searches, which are associated with different search algorithms for different codecs, may not result in the desired effect of freeing up processing power or memory. Instead, an additional processing burden would be imposed on the co-processor. Implementing the fixed codebook searches on two different co-processors may be more effective but not necessarily more efficient.

SUMMARY

This disclosure provides a system and method for supporting multiple speech codecs.

In a first aspect, a method for performing a search of a codebook is provided. The codebook includes a plurality of tracks each having a plurality of even pulse positions. The method includes partitioning a codevector having a plurality of pulses into a first subset of pulses and a second subset of pulses. Each pulse is assignable to a pulse position in the codevector, and each pulse is associated with a shift bit for indicating an odd position. The method also includes performing a first search for determining a first set of possible pulse positions for the pulses in the codevector. The method further includes performing a second search for determining a second set of possible pulse positions for the pulses in the codevector. In addition, the method includes forming the codevector using the first and second sets of possible pulse positions.

In particular aspects, the method includes repeating the partitioning, performing, and forming steps to produce a second codevector associated with a second codebook. The second codevector includes pulses not associated with shift bits, and the second codebook includes tracks having a plurality of odd and even pulse positions. In other particular aspects, the codebook represents a G.723.1 codebook, and the second codebook represents a G.729A codebook.

In a second aspect, a system includes a processor capable of performing functions for at least one of encoding and decoding communication signals. The system also includes a co-processor capable of performing a search of a codebook to support at least one of encoding and decoding of the communication signals. The codebook includes a plurality of tracks each having a plurality of even pulse positions. The co-processor is capable of performing the search by partitioning a codevector having a plurality of pulses into a first subset of pulses and a second subset of pulses. Each pulse is assignable to a pulse position in the codevector, and each pulse is associated with a shift bit for indicating an odd position. The co-processor is also capable of performing a first search for determining a first set of possible pulse positions for the pulses in the codevector. The co-processor is further capable of performing a second search for determining a second set of possible pulse positions for the pulses in the codevector. In addition, the co-processor is capable of forming the codevector using the first and second sets of possible pulse positions.

In a third aspect, a computer program is embodied on a computer readable medium and is operable to be executed by a processor. The computer program is for performing a search of a codebook, where the codebook includes a plurality of tracks each having a plurality of even pulse positions. The computer program includes computer readable program code for partitioning a codevector having a plurality of pulses into a first subset of pulses and a second subset of pulses. Each pulse is assignable to a pulse position in the codevector, and each pulse is associated with a shift bit for indicating an odd position. The computer program also includes computer readable program code for performing a first search for determining a first set of possible pulse positions for the pulses in the codevector. The computer program further includes computer readable program code for performing a second search for determining a second set of possible pulse positions for the pulses in the codevector. In addition, the computer program includes computer readable program code for forming the codevector using the first and second sets of possible pulse positions.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1:
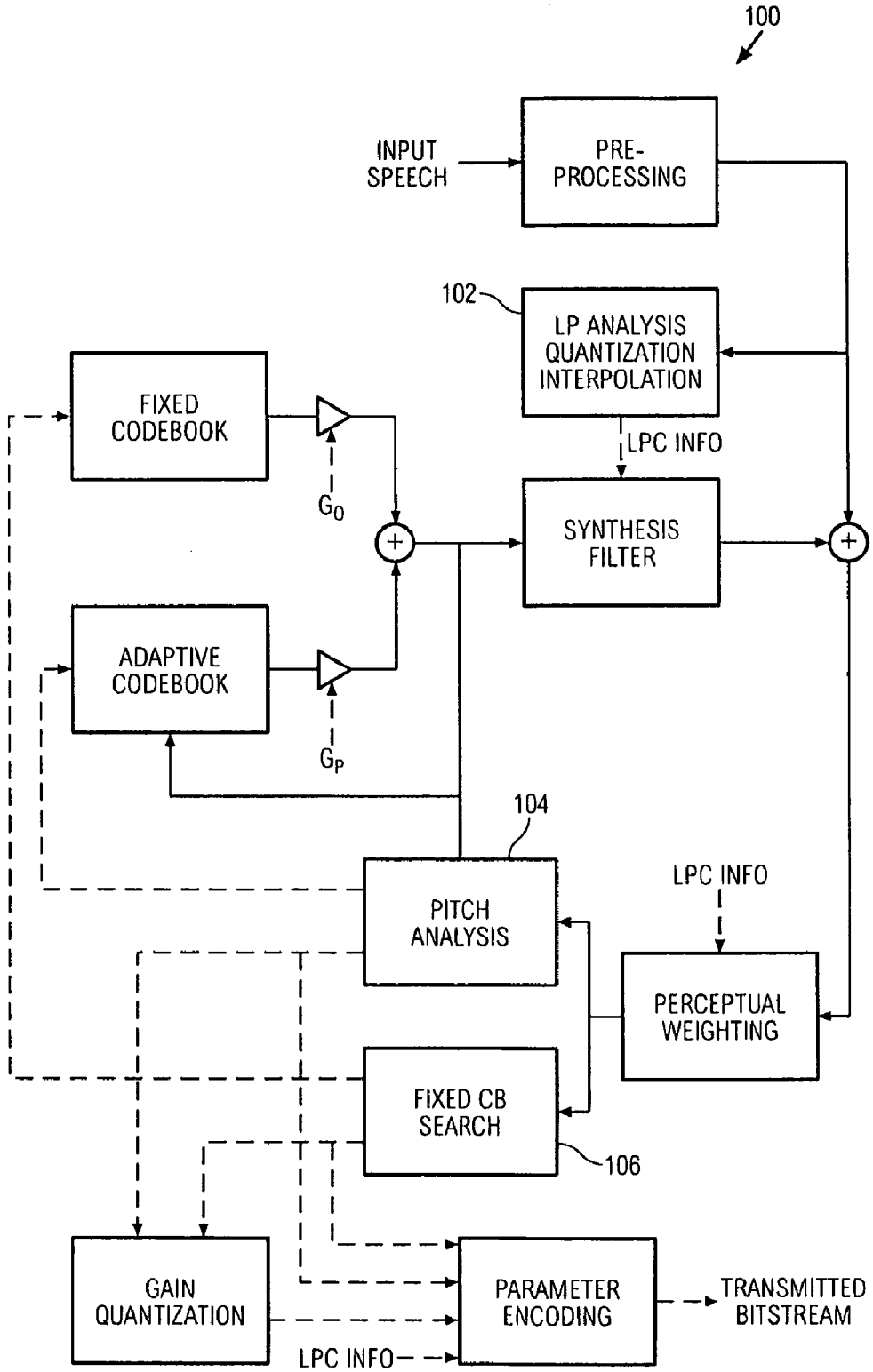
FIG. 1 (PRIOR ART)
FIG. 1 illustrates a conventional Algebraic-Code-Excited Linear-Prediction (ACELP) encoder.

FIGS. 2 through 10B, discussed below, and the various embodiments described in this disclosure are by way of illustration only and should not be construed in any way to limit the scope of the claimed invention. Those skilled in the art will understand that the principles described in this disclosure may be implemented in any suitably arranged device or system.

As described in more detail below, particular embodiments of this disclosure may support multiple codecs on a single co-processor. For example, the G.723.1 (5.3 kbps) codec and the G.729A codec could be supported on a single co-processor. Also, a single fixed codebook search algorithm may be used for both the G.723.1 codec and the G.729A codec. This may help to simplify the fixed codebook search process so that a single co-processor running the fixed codebook search algorithm may be used for both codecs. As a particular example, the fixed codebook search algorithm of the G.723.1 codec could be modified to be similar to that of the G.729A codec, such as by using a "depth-first tree search" fixed codebook search algorithm with the G.723.1 codec as well as with the G.729A codec.

Fixed codebook search algorithms are typically used in conjunction with a codebook. A codebook, in the CELP context, typically represents an indexed set of L-sample long sequences, referred to as L-dimensional "codevectors." The codebook includes an index ν ranging from 1 to M, where M represents the size of the codebook. The size of the codebook may be expressed as a number of bits b, where:

$$M=2^b. \tag{1}$$

An algebraic codebook typically represents a set of indexed codevectors $v_\xi$. Each codevector defines a plurality of different positions p and N non-zero amplitudes pulses, where each pulse is assignable to a predetermined valid position p of the codevector. The amplitudes and positions of the pulses of the $\xi^{th}$ codevector can be derived from a corresponding index ξ through a rule requiring minimal physical storage. Therefore, algebraic codebooks typically are not limited by storage requirements and are designed for efficient searches.

The conventional G.723.1 (5.3 kbps) codebook search uses a 17-bit algebraic codebook for a fixed code excitation v[n]. Each fixed codevector contains, at most, four non-zero pulses. The four pulses can assume the signs and positions shown in Table 1.

TABLE 1

| Pulse Number | Track | Sign | Positions |
|---|---|---|---|
| 0 | $T_0$ | $S_0$: ±1 | $m_0$: 0, 8, 16, 24, 32, 40, 48, 56 |
| 1 | $T_1$ | $S_1$: ±1 | $m_1$: 2, 10, 18, 26, 34, 42, 50, 58 |
| 2 | $T_2$ | $S_2$: ±1 | $m_2$: 4, 12, 20, 28, 36, 44, 52, (60) |
| 3 | $T_3$ | $S_3$: ±1 | $m_3$: 6, 14, 22, 30, 38, 46, 54, (62) |

A codebook vector v(n) may be constructed by taking a zero vector of dimension 60 and placing four unit pulses at four locations (each pulse multiplied with its corresponding sign). This can be represented by the following equation:

$$v(n)=s_0\delta(n-m_0)+s_1\delta(n-m_1)+s_2\delta(n-m_2)+s_3\delta(n-m_3),\quad n=0,\ldots,59 \tag{2}$$

where δ (0) represents a unit pulse.

The positions of the pulses can be simultaneously shifted by one (to occupy odd positions). This may require the use of an extra bit, referred to as a "shift bit." The last position of each of the last two pulses may fall outside a subframe boundary, which signifies that the pulses are not present.

In some embodiments, each pulse position is encoded in three bits, and each pulse sign is encoded in one bit. This gives a total of sixteen bits for the four pulses. Also, an extra bit may be used to encode the shift, resulting in a 17-bit codebook.

The codebook may be searched by minimizing a mean square error between a weighted speech signal r[n] and a weighted synthesis speech signal. This may be expressed as:

$$E_\xi = \|r - GHv_\xi\| \tag{3}$$

where E represents the error, r represents a target vector containing the weighted speech signal after subtracting a zero-input response of a weighted synthesis filter and a pitch contribution, G represents the codebook gain, $v_\xi$ represents the algebraic codeword at index ξ, and H represents a lower triangular Toeplitz convolution matrix with diagonal h(0) and lower diagonals h(1), . . . , h(L−1), with h(n) being the impulse response of the weighted synthesis filter $S_i(z)$. It can be shown that an optimum codeword is one that maximizes the term:

$$\tau_\xi = \frac{C_\xi^2}{\varepsilon_\xi} = \frac{(d^T v_\xi)^2}{v_\xi \varphi v_\xi} \tag{4}$$

where $C_\xi$ represents a correlation value at index $\xi$, $\epsilon_\xi$ represents an energy at index $\xi$, $d=H^T r$ represents a correlation between the target vector signal r[n] and the impulse response h(n), and $\phi=H^T H$ represents the covariance matrix of the impulse response. The vector d and the matrix $\phi$ may be computed prior to the codebook search. The elements of the vector d may be computed using the following formula:

$$d(j) = \sum_{n=j}^{59} r[n] \cdot h[n-j],\ 0 \leqslant j \leqslant 59. \tag{5}$$

The elements of the symmetric matrix $\phi(i,j)$ may be computed using the following formula:

$$\varphi(i, j) = \sum_{n=j}^{59} h[n-i] \cdot h[n-j],\ j \geqslant i,\ 0 \leqslant i \leqslant 59. \tag{6}$$

The algebraic structure of the codebook allows for very fast search procedures since the excitation vector $v_\xi$ contains only four non-zero pulses. The conventional G.723.1 (5.3 kbps) codebook search is performed in four nested loops corresponding to each pulse position, where in each loop the contribution of a new pulse is added.

The correlation in equation (4) may be given by:

$$C=\alpha_0 d[m_0]+\alpha_1 d[m_1]+\alpha_2 d[m_2]+\alpha_3 d[m_3] \tag{7}$$

where $m_k$ represents the position of the $k^{th}$ pulse, and $\alpha_k$ represents the sign (±1) of the $k^{th}$ pulse. The energy for even pulse position codevectors in equation (4) may be given by:

$$\varepsilon = \sum_{i=0}^{3} \varphi(m_i, m_i) + 2\sum_{i=0}^{2} \sum_{j=i+1}^{3} \alpha_i \alpha_j \varphi(m_i, m_j). \tag{8}$$

For odd pulse position codevectors, the energy in equation (4) may be approximated by the energy of the equivalent even pulse position codevector obtained by shifting the odd position pulses to one sample earlier in time.

To simplify the search procedure, the functions d[j] and $\phi(m_i,m_j)$ may be modified. This simplification may be performed as follows, and it may occur prior to the codebook search. The signal s[j] is defined using the following formula:

$$s[2j]=s[2j+1]=\text{sign}(d[2j]) \text{ if } |d[2j]|>|d[2j+1]|$$

$$s[2j]=s[2j+1]=\text{sign}(d[2j+1])\text{otherwise}. \tag{9}$$

A signal d'[j] is constructed as given by d'[j]=d[j]s[j]. The matrix $\phi$ may be modified by including the signal information, where $\phi'(i,j)=s[i]s[j]\phi(i,j)$. The correlation in equation (7) may now be expressed as:

$$C=d'[m_0]+d'[m_1]+d'[m_2]+d'[m_3]. \tag{10}$$

The energy in equation (8) may now be expressed as:

$$\varepsilon = \sum_{i=0}^{3} \varphi'(m_i, m_i) + 2\sum_{i=0}^{2} \sum_{j=i+1}^{3} \varphi'(m_i, m_j), \tag{11}$$

which may be further expanded to obtain:

$$\begin{aligned}\varepsilon = \varphi'(m_0, m_0) + \varphi'(m_1, m_1) + 2\varphi'(m_0, m_1) + \\ \varphi'(m_2, m_2) + 2[\varphi'(m_0, m_2) + \varphi'(m_1, m_2)] + \\ \varphi'(m_3, m_3) + 2[\varphi'(m_0, m_3) + \varphi'(m_1, m_3) + \varphi'(m_2, m_3)].\end{aligned} \tag{12}$$

In conventional G.723.1 (5.3 kbps) codecs, the four pulses are divided into four tracks, each pulse position corresponds to one track, and each track has eight possible pulse positions. In an "exhaustive nested-loop search" approach, there are four nested loops. A "focused nested-loop search" approach is used to simplify the search procedure. A predetermined threshold is tested before entering the last loop, and the loop is entered only if this threshold is exceeded. The maximum number of times the loop can be entered is fixed so that a lower percentage of the codebook is searched. This threshold is computed based on the correlation C as given in equation (10). The maximum absolute correlation $\max_3$ and the average correlation $av_3$ due to the contribution of the first three pulses may be found prior to the codebook search. The threshold may be given by:

$$thr_3=av_3+(\max_3-av_3)/2. \tag{13}$$

The fourth loop is then entered only if the absolute correlation (due to three pulses) exceeds the value of $thr_3$. This results in a variable complexity search. To further control the search, the number of times the last loop is entered (for four subframes) may not be allowed to exceed 600 (the average worst case per subframe is 150 times, which can be viewed as searching only 150×8 or 2,000 entries of the codebook, ignoring the overhead of the first three loops). In exhaustive nested-loop searches, $8^4$ or 4,096 possible pulse positions are searched.

In the conventional G.729 codec, the fixed codebook is based on an algebraic codebook structure using an Interleaved Single-Pulse Permutation (ISPP) design. In this codebook, each codebook vector contains four non-zero pulses. Each pulse can have either the amplitude +1 or −1. Also, each pulse can assume the positions given in Table 2, which illustrates the structure of the fixed codebook.

TABLE 2

| Pulse Number | Track | Sign | Positions |
|---|---|---|---|
| 0 | $T_0$ | $S_0$: ±1 | $m_0$: 0, 5, 10, 15, 20, 25, 30, 35 |
| 1 | $T_1$ | $S_1$: ±1 | $m_1$: 1, 6, 11, 16, 21, 26, 31, 36 |
| 2 | $T_2$ | $S_2$: ±1 | $m_2$: 2, 7, 12, 17, 22, 27, 32, 37 |
| 3 | $T_3$ | $S_3$: ±1 | $m_3$: 3, 8, 13, 18, 23, 28, 33, 38<br>4, 9, 14, 19, 24, 29, 34, 39 |

The codebook vector v(n) may be constructed by taking a zero vector of dimension 40 and placing four unit pulses at four locations (each pulse multiplied with its corresponding sign). This can be represented by the following equation:

$$v(n)=s_0\delta(n-m_0)+s_1\delta(n-m_1)+s_2\delta(n-m_2)+s_3\delta(n-m_3),\quad n=0,\ldots,39 \tag{14}$$

where δ (0) represents a unit pulse.

The fixed codebook may be searched by minimizing a mean squared error as shown in equation (3). The matrix H may be defined as the lower triangular Toeplitz convolution matrix with diagonal h(0) and lower diagonal h(1), . . . , h(39). The matrix $\phi=H'H$ may contain the correlations of h(n), and the elements of this symmetric matrix may be given by:

$$\varphi(i,j)=\sum_{n=j}^{39} h[n-i]\cdot h[n-j],\ j\geqslant i,\ 0\leqslant i\leqslant 39. \tag{15}$$

The correlation signal d(n) may be obtained from the target signal r(n) and the impulse response h(n) by:

$$d(j)=\sum_{n=j}^{39} r[n]\cdot h[n-j],\ 0\leqslant j\leqslant 39. \tag{16}$$

If $v_\xi$ is the $\xi^{th}$ fixed codebook vector, the codebook may be searched by maximizing the term:

$$\tau_\xi=\frac{C_\xi^2}{\varepsilon_\xi}=\frac{\left(\sum_{n=0}^{39} d(n)v_\xi(n)\right)^2}{v_\xi\varphi v_\xi} \tag{17}$$

The signal d(n) and the matrix φ may be computed before the codebook search. Only the elements actually needed may be computed, and an efficient storage procedure may speed up the search procedure.

The algebraic structure of the codebook allows for a fast search procedure since the codebook vector $v_\xi$ contains only four non-zero pulses. The correlation in the numerator of equation (17) for a given vector $v_\xi$ may be given by:

$$C=\alpha_0 d[m_0]+\alpha_1 d[m_1]+\alpha_2 d[m_2]+\alpha_3 d[m_3] \tag{18}$$

where $m_i$ represents the position of the $i^{th}$ pulse, and $\alpha_i$ represents the amplitude of the $i^{th}$ pulse. The energy in the denominator of equation (17) may be given by:

$$\varepsilon=\sum_{i=0}^{3}\varphi(m_i,m_i)+2\sum_{i=0}^{2}\sum_{j=i+1}^{3}\alpha_i\alpha_j\varphi(m_i,m_j). \tag{19}$$

To simplify the search procedure, the pulse amplitudes may be predetermined by quantizing the signal d(n). This may be done by setting the amplitude of a pulse at a certain position equal to the sign of d(n) at that position. Before the codebook search, the following steps may be performed. The signal d(n) may be decomposed into two parts, its absolute value |d(n)| and its sign (denoted "sign [d (n)] "). The matrix φ may be modified by including the sign information, such as:

$$\phi'(i,j)=\mathrm{sign}[d(i)]\mathrm{sign}[d(j)]\phi(i,j),i=0,\ldots,39,j=i+1,\ldots 39. \tag{20}$$

The main-diagonal elements of φ may be scaled to remove the factor of two in Equation (19) as follows:

$$\phi'(i,i)=0.5\phi'(i,i),i=0\ldots,39. \tag{21}$$

The correlation in Equation (18) may now be given by:

$$C=|d(m_0)|+|d(m_1)|+|d(m_2)|+|d(m_3)|. \tag{22}$$

The energy in Equation (19) may now be given by:

$$\frac{\varepsilon}{2}=\sum_{i=0}^{3}\varphi'(m_i,m_i)+\sum_{i=0}^{2}\sum_{j=i+1}^{3}\varphi'(m_i,m_j), \tag{23}$$

which may be further expanded to obtain:

$$\begin{aligned}\frac{\varepsilon}{2}=&\varphi'(m_0,m_0)+\varphi'(m_1,m_1)+\varphi'(m_0,m_1)+\\&\varphi'(m_2,m_2)+\varphi'(m_0,m_2)+\varphi'(m_1,m_2)+\\&\varphi'(m_3,m_3)+\varphi'(m_0,m_3)+\varphi'(m_1,m_3)+\varphi'(m_2,m_3)\end{aligned} \tag{24}$$

A "focused nested-loop search" approach may be used to further simplify the search procedure. In this approach, a precomputed threshold may be tested before entering the last loop, and the loop is entered only if this threshold is exceeded. The maximum number of times the loop can be entered is also fixed so that a low percentage of the codebook is searched. The threshold may be computed based on the correlation C. The maximum absolute correlation $\max_3$ and the average correlation $av_3$ due to the contribution of the first three pulses may be found before the codebook search. The threshold may be given by:

$$thr_3=av_3+K_3(\max_3-av_3). \tag{25}$$

The fourth loop may be entered only if the absolute correlation (due to three pulses) exceeds $thr_3$, where $0\leqq K_3<1$. The value of $K_3$ controls the percentage of the codebook searched, and it may be set to 0.4 as an example. This results in a variable search time. To further control the search, the number of times that the last loop is entered (for two subframes) may not exceed a certain maximum, which may be set to 180 (the average worst case per subframe is 90 times, so the total possible pulse search combination would be 180*8 or 1,440). In exhaustive nested-loop searches, $8^4$*2 or 8,192 possible pulse positions are searched.

In a fixed codebook search for the G.729A codec, a "depth-first tree search" algorithm is used in place of a "focused nested-loop search." In the G.729 codec, a fast search procedure based on a nested-loop search approach is used, and only 1,440 possible position combinations are tested in the worst case out of 213 position combinations (17.5 percent). In the G.729A codec, search criteria $C^2/\epsilon$ tested for a smaller percentage of possible position combinations using a depth-first tree search approach. In this approach, the P excitation pulses in a subframe are partitioned into M subsets of $N_m$ pulses. The search begins with the first subset and proceeds with subsequent subsets according to a tree structure, whereby subset m is searched at the $m^{th}$ level of the tree. The search may be repeated by changing the order in which pulses are assigned to the position tracks.

In particular codebook structures, the pulses may be partitioned into two subsets (M=2) of two pulses ($N_m$=2). The codebook search is started with the following assignments of pulses to tracks: pulse $i_0$ is assigned to track $T_2$, pulse $i_1$ is assigned to track $T_3$, pulse $i_2$ is assigned to track $T_0$, and pulse $i_3$ is assigned to track $T_1$. The search starts with determining the positions of pulses $i_0$ and $i_1$ by testing a predetermined search criteria for 2×8 or 16 position combinations (i.e. the positions at two maxima of $|d(n)|$ in track $T_2$ are tested in combination with the eight positions in track $T_3$). Once the positions of pulses $i_0$ and $i_1$ are found, the search proceeds to determine the positions of pulses $i_2$ and $i_3$ by testing the search criteria for the 8×8 or 64 position combinations in tracks $T_0$ and $T_1$. The procedure is repeated by cyclically shifting the pulse assignments to the tracks, such as when pulse $i_0$ is assigned to track $T_3$, pulse $i_1$ is assigned to track $T_0$, pulse $i_2$ is assigned to track $T_1$, and pulse $i_3$ is assigned to track $T_2$. The whole procedure is repeated twice by replacing track $T_3$ with track $T_4$ since the fourth can be placed in either $T_3$ or $T_4$. Thus, in total, (64+16)*4 or 320 position combinations are tested (about 3.9 percent of all possible position combinations). About fifty percent of the complexity reduction in the coder may be attributed to the new algebraic codebook search. This is at the expense of a slight degradation in coder performance (about 0.2 dB drop in the signal-to-noise ratio).

The positions of pulses $i_0$, $i_1$ and $i_2$ may be encoded with three bits each, and the position of pulse $i_3$ may be encoded with four bits. Each pulse amplitude may be encoded with one bit. This gives a total of 17 bits for the four pulses. By defining s=1 if the sign is positive and s=0 if the sign is negative, the sign codeword may be obtained from:

$$S=s_0+2s_1+4s_2+8s_3, \tag{25}$$

and the fixed codebook codeword may be obtained from:

$$C=(m_0/5)+8(m_1/5)+64(m_2/5)+512(2(m_3/5)+jx) \tag{26}$$

where jx=0 if $m_3$=3, 8, . . . , 38 and jx=1 if $m_3$=4, 9 . . . , 39.

A "focus nested-loop search" algorithm is currently used for conventional G.723.1 and G.729 codebook searches. A "depth-first tree search" algorithm is currently used for G.729A codebook searches. By adopting a single fixed codebook search algorithm for both G.723.1 and G.729A, this may simplify the fixed codebook search process so that a single co-processor running one fixed codebook search algorithm may be used for both codecs.

This disclosure proposes a new G.723.1 codebook search algorithm based on a "depth-first tree search" approach, thus having the desired effect of providing one fixed codebook search for both G.723.1 and G.729A codecs. In general, the proposed G.723.1 codebook search algorithm searches a subset of pulses in a subset of tracks rather than searching in a full range of tracks, thereby reducing the number of possible pulse positions being searched.

The similarities and differences between the G.723.1 and G.729A fixed codebook searches are shown below. There are several fixed parameters for both speech codecs:

Number of pulses (N)=4 (both codecs)

Number of samples per subframe=40/60 (G.729A/G.723.1)

Number of tracks=4 (both codecs)

Number of pulse positions per track=8 (both codecs)

Step for speech codec=5/8 (G.729A/G.723.1).

Also, the initial pulse positions for the speech codecs are different. For the G.723.1 codec, the initial positions are $i_0$=0, $i_1$=2, $i_2$=4, and $i_3$=6. For the G.729A codec, the initial positions are $i_0$=0, $i_1$=1, $i_2$=2, and $i_3$=3. This can be seen by comparing Table 1 and Table 2 above.

Figure 2:
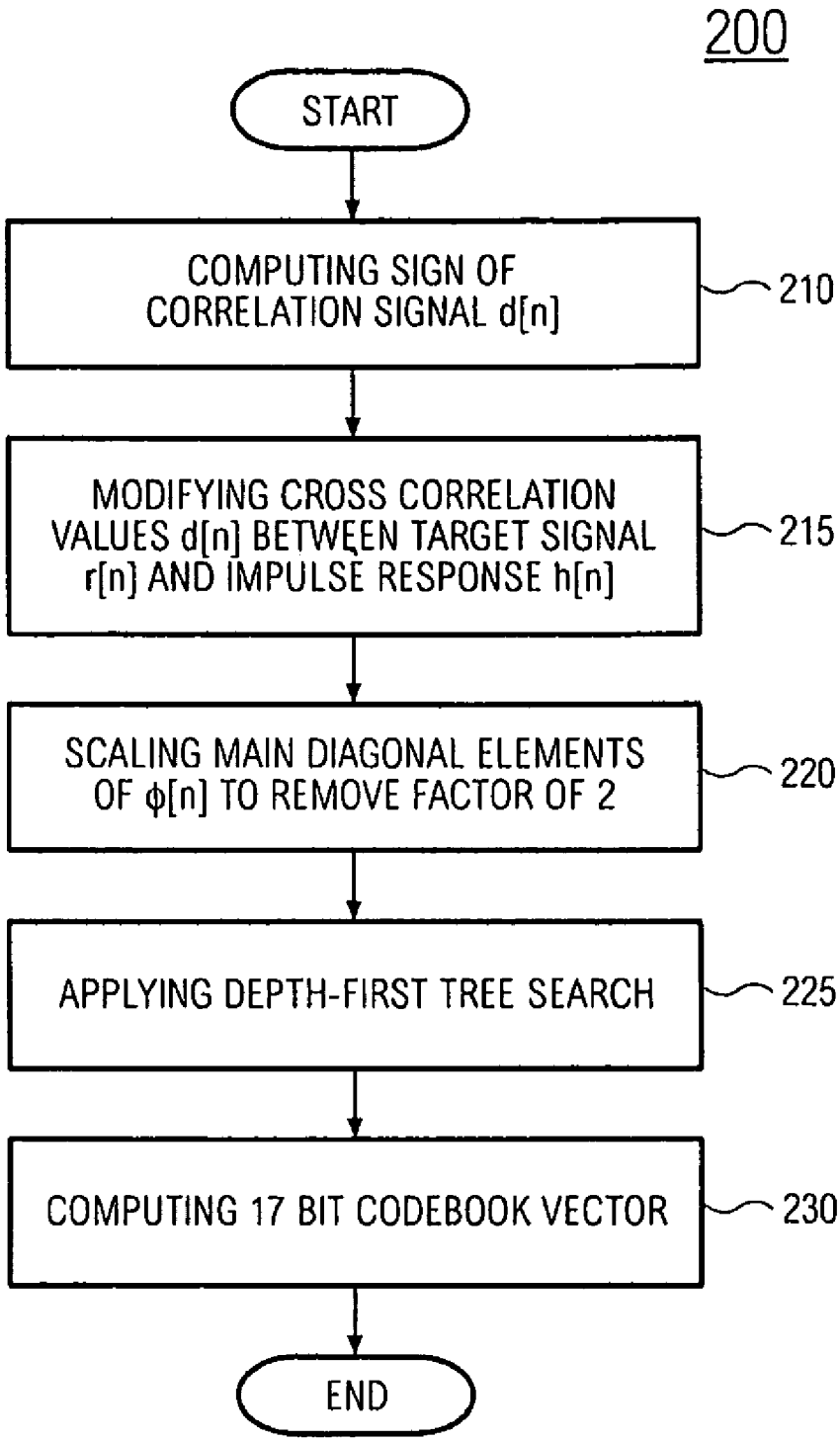
FIG. 2 illustrates a method for performing a fixed codebook search according to one embodiment of this disclosure.

FIG. 2 illustrates a method 200 for performing a fixed codebook search according to one embodiment of this disclosure. The method 200 adopts a "depth-first tree search" algorithm approach for a G.723.1 fixed codebook search.

Figure 3:
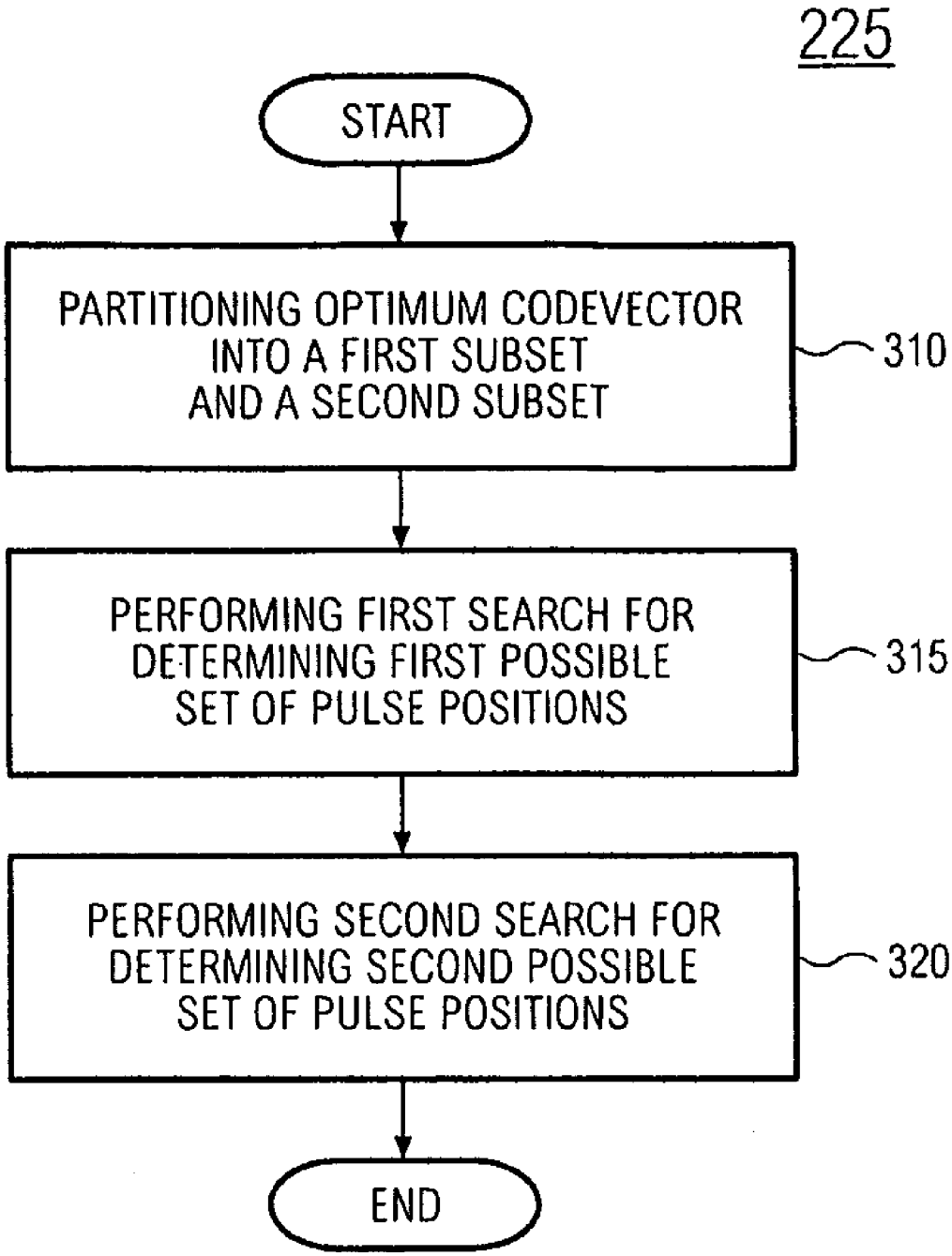
FIG. 3 illustrates a method for performing a depth-first tree search during the method of FIG. 2 according to one embodiment of this disclosure.

The method 200 begins by computing a sign of the correlation signal d(n) at step 210. This may occur in the same or similar manner as in the conventional ITU-T G.723.1 codec. Depending on the sign, cross correlation values d(n) between target signal r(n) and impulse response h(n) are modified at step 215. The main diagonal elements of $\phi p(n)$ are scaled at step 220 to remove the factor of two as given in equation (11) above. A depth-first tree search is used to find the best possible pulse positions that maximize search criteria at step 225. One example of step 225 is shown in FIG. 3. Finally, a 17-bit codebook vector is computed at step 230.

FIG. 3 illustrates a method 225 for performing a depth-first tree search during the method of FIG. 2 according to one embodiment of this disclosure. As noted above in Table 1, the ACELP codebook for G.723.1 (5.3 kbps) has four pulses that are searched for in four tracks. The method 225 for applying the depth-first tree search begins by partitioning the pulses of the optimum codevector into a first subset and a second subset (M=2) at step 310. The first subset has a first pulse and a second pulse, and the second subset has the third and fourth pulse ($N_m$=2).

The method 225 then proceeds with performing a first search for determining a first possible set of pulse positions at step 315, followed by performing a second search for determining a second possible set of pulse positions at step 320. Each search includes two phases (denoted "A" and "B"), providing the following sequence:

Search 1, Phase A
Search 1, Phase B
Search 2, Phase A
Search 2, Phase B.

Figure 4:
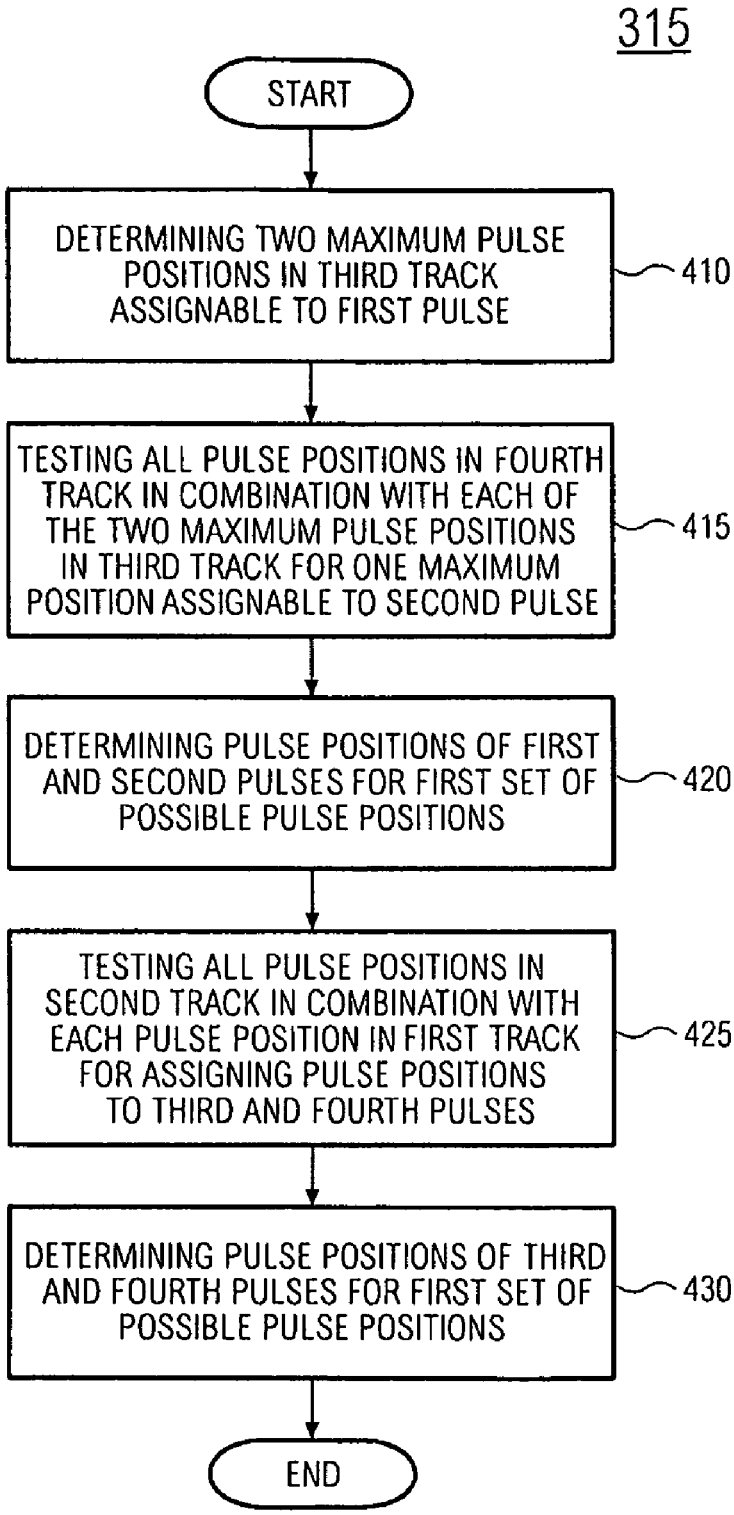
FIG. 4 illustrates a method for performing a first search during the method of FIG. 3 according to one embodiment of this disclosure.
Figure 5:
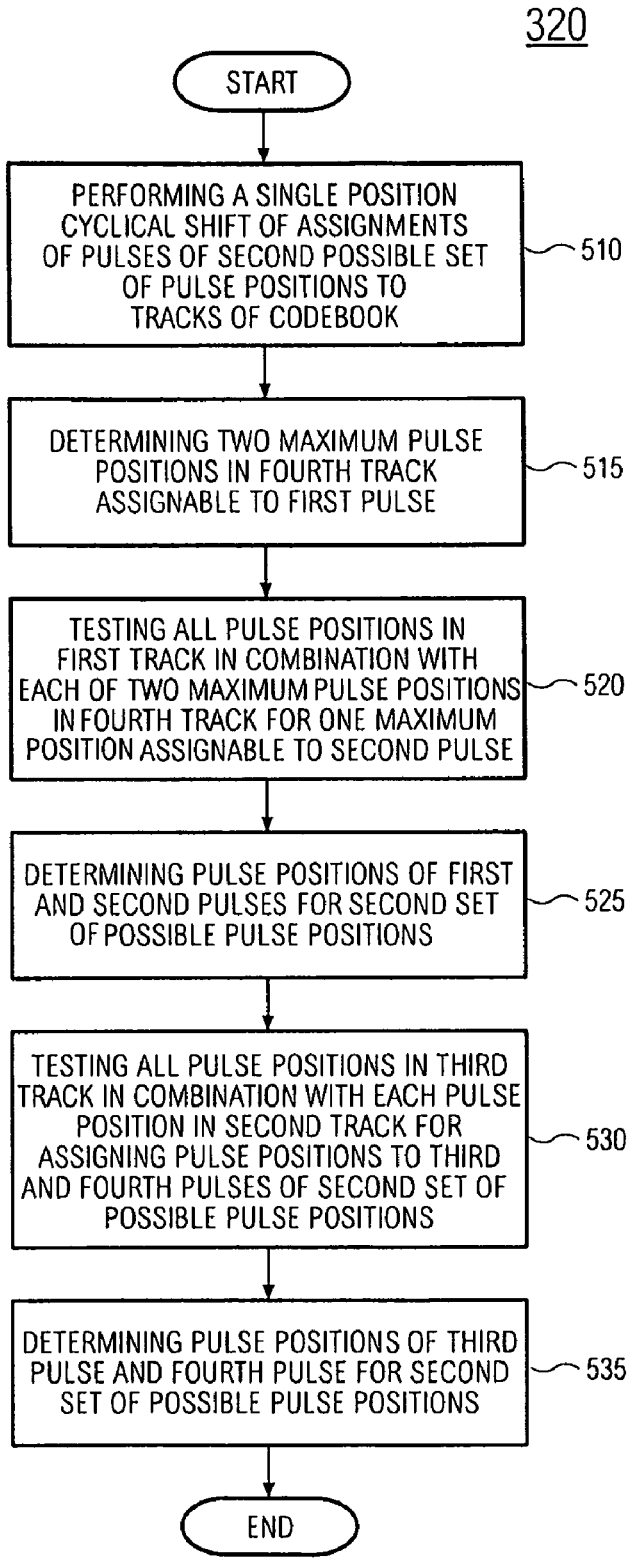
FIG. 5 illustrates a method for performing a second search during the method of FIG. 3 according to one embodiment of this disclosure.

One example of step 315 is shown in FIG. 4, and one example of step 320 is shown in FIG. 5. In some embodiments, the first codebook search at step 315 begins with the following pulse/track assignments: pulse $i_0$ is assigned to the third track $T_2$, pulse $i_1$ is assigned to the fourth track $T_3$, pulse $i_2$ is assigned to the first track $T_0$, and pulse $i_3$ is assigned to the second track $T_1$.

FIG. 4 illustrates a method 315 for performing a first search during the method of FIG. 3 according to one embodiment of this disclosure. In particular, the method 315 is used to determine a first set of possible pulse positions.

In Phase A of Search 1, the positions of pulses $i_0$ and $i_1$ are determined by testing the search criteria for 2×8 or 16 position combinations. In other words, the positions at two maxima of $|d(n)|$ in track $T_2$ (including even and odd indexed pulse positions) are tested in combination with the eight positions in track $T_3$ (including odd and even indexed pulse positions). In this manner, the positions of pulses $i_0$ and $i_1$ are found.

The method 315 begins by determining the two maximum pulse positions in the third track assignable to the first pulse $i_0$ at step 410. Next, the pulse positions in the fourth track are tested in combination with each of the two maximum pulse positions in the third track at step 415. This results in one maximum pulse position being assignable to the second pulse $i_1$. The positions of pulses $i_0$ and $i_1$ for the first set of possible pulse positions are then determined in accordance with the predetermined search criteria at step 420.

In Phase B of Search 1, the search proceeds to determine the positions of pulses $i_2$ and $i_3$ by testing the search criteria for the 8×8 or 64 position combinations in tracks $T_0$ and $T_1$ (including odd and even indexed pulse positions). The method 315 continues by testing the pulse positions in the second track in combination with each of the pulse positions in the first track at step 425. The pulse positions of the third pulse and the fourth pulse in the first set of possible pulse positions are determined in accordance with the predetermined search criteria at step 430. In this manner, the positions of pulses $i_2$ and $i_3$ are found, and a total of 16+64 or 80 possible pulse position combinations have been searched.

In other embodiments, the correlation signal values of each pulse position of the first set are compared at both even and odd indexed pulse positions. Whichever value is higher may be selected and re-assigned as the pulse position. If the odd indexed correlation signal value is higher, the "shift bit" value may be set to one. Otherwise, if the even correlation signal value is higher, the "shift bit" value may be set to zero. This may be summarized as follows:

```
if (dn[i] > dn[i+1]) // where i is even index
    shift = 0
else
    shift = 1.
```

FIG. 5 illustrates a method 320 for performing a second search during the method of FIG. 3 according to one embodiment of this disclosure. In particular, the method 320 is used to determine a second set of possible pulse positions.

The method 320 begins by performing a cyclical shift of the pulse assignments to the tracks at step 510. For example, pulse $i_0$ may be reassigned to track $T_3$, pulse $i_1$ may be reassigned to track $T_0$, pulse $i_2$ may be reassigned to track $T_1$, and pulse $i_3$ may be reassigned to track $T_2$.

In Phase A of Search 2, a procedure similar to that of step 315 is performed. The two maximum pulse positions in the fourth track assignable to the first pulse $i_0$ are determined at step 515. The pulse positions in the first track are tested in combination with each of the two maximum pulse positions in the fourth track at step 520. This may result in one maximum pulse position assignable to the second pulse $i_1$. The pulse positions $i_0$ and $i_1$ for the second set of possible pulse positions are then determined in accordance with the predetermined search criteria at step 525.

In Phase B of Search 2, the positions $i_2$ and $i_3$ are determined by testing the search criteria for the 8×8 or 64 position combinations in tracks $T_3$ and $T_0$ (including odd and even indexed pulse positions). The pulse positions in the third track are tested in combination with each of the pulse positions in the second track at step 530. The pulse positions of the third pulse and the fourth pulse of the second set are determined in accordance with the predetermined search criteria at step 535.

In other embodiments, the correlation signal values of each pulse position of the second set are again compared at both even and odd indexed pulse positions. Thus, in total, (64+16) *2 or 160 position combinations are searched. This may compare to, for example, approximately 2,000 positions searched in the original ITU-T G.723.1 fixed codebook search, which represents about 8 percent of the original G.723.1 fixed codebook search.

The first and second sets of possible pulse positions may then be compared. The four final pulse positions are then selected from the first and second sets, and the selected pulse positions and their sign and shift values are used to compute the 17-bit codebook vector. In this way, decoder compatibility may not be lost due to the change in the algorithm. Using this technique, there may be up to a 50 percent or more reduction in the complexity of the G.723.1 (5.3 kbps) algebraic codebook search.

Figure 6A:
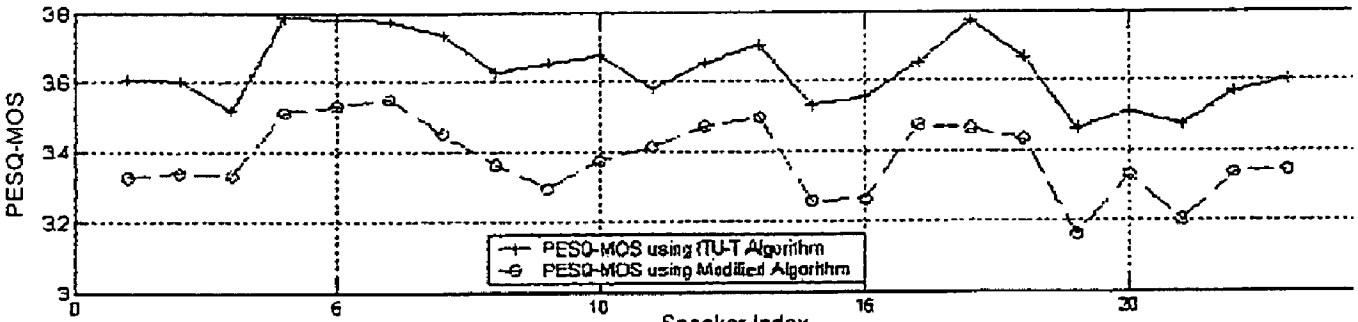
FIGS. 6A through 6C illustrate simulation results of the method of FIG. 2 according to one embodiment of this disclosure.
Figure 6B:
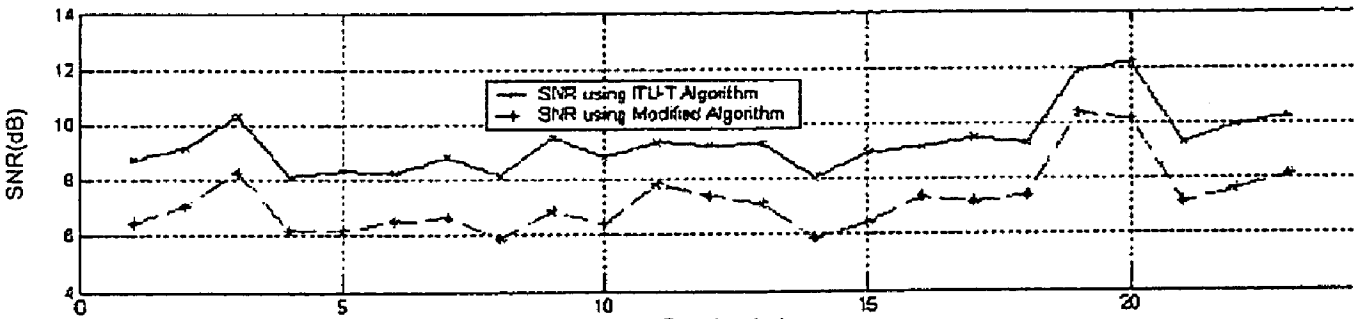
Figure 6C:
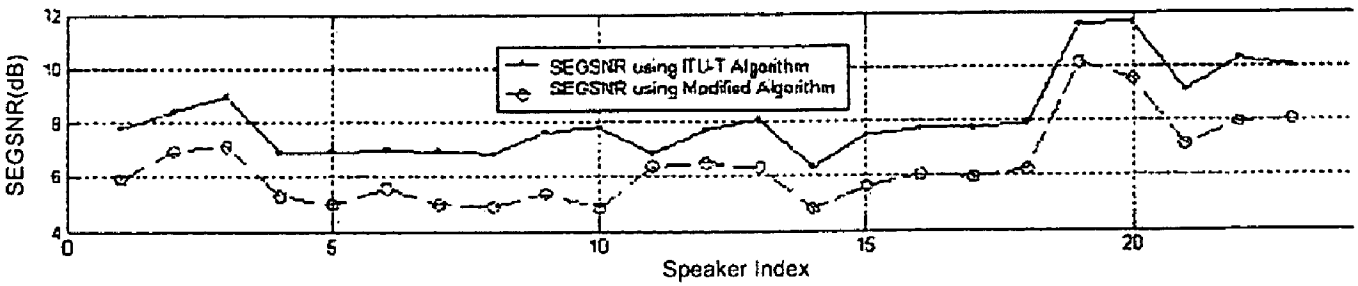

FIGS. 6A through 6C illustrate simulation results of the method of FIG. 2 according to one embodiment of this disclosure. The simulations were performed for both the ITU-T version of the G.723.1 search algorithm and for the algorithm of FIG. 2 using 23 speech test vectors. About 20 speech test vectors were taken from the ITU-T P.862 standards, where the test vectors are generated from different sources (including women, men, and children, as well as different language speakers). Three other test vectors represent sample test speech vectors of about one minute each. Three types of validation tests were carried out, including Perceptual Evaluation of Speech Quality (PESQ) Mean Opinion Score (MOS), Signal-to-Noise Ratio (SNR), and Segmental Signal-to-Noise Ratio (SEGSNR).

FIG. 6A shows the PESQ-MOS score comparison for the algorithm of FIG. 2 and the ITU-T algorithm using the 23 test vectors. The PESQ-MOS score for the modified algorithm varies from 3.4 to 3.55 for different test vectors, as compared to the PESQ-MOS score for the original ITU-T algorithm that varies from 3.5 to 3.8. This shows a slight (5-8 percent) degradation of the PESQ-MOS score for the modified algorithm of FIG. 2 as compared to the original ITU-T algorithm. However, this degradation in performance is balanced by more than 50 percent savings in the complexity of the algorithm.

FIGS. 6B and 6C show the SNR and SEGSNR performances, respectively, of both algorithms for the 23 speech test vectors. The results show an approximate 2 dB SNR degradation and an approximate 1.5 dB SEGSNR degradation in the modified algorithm compared to the original ITU-T algorithm.

Figures 7A, 7B, 7C:
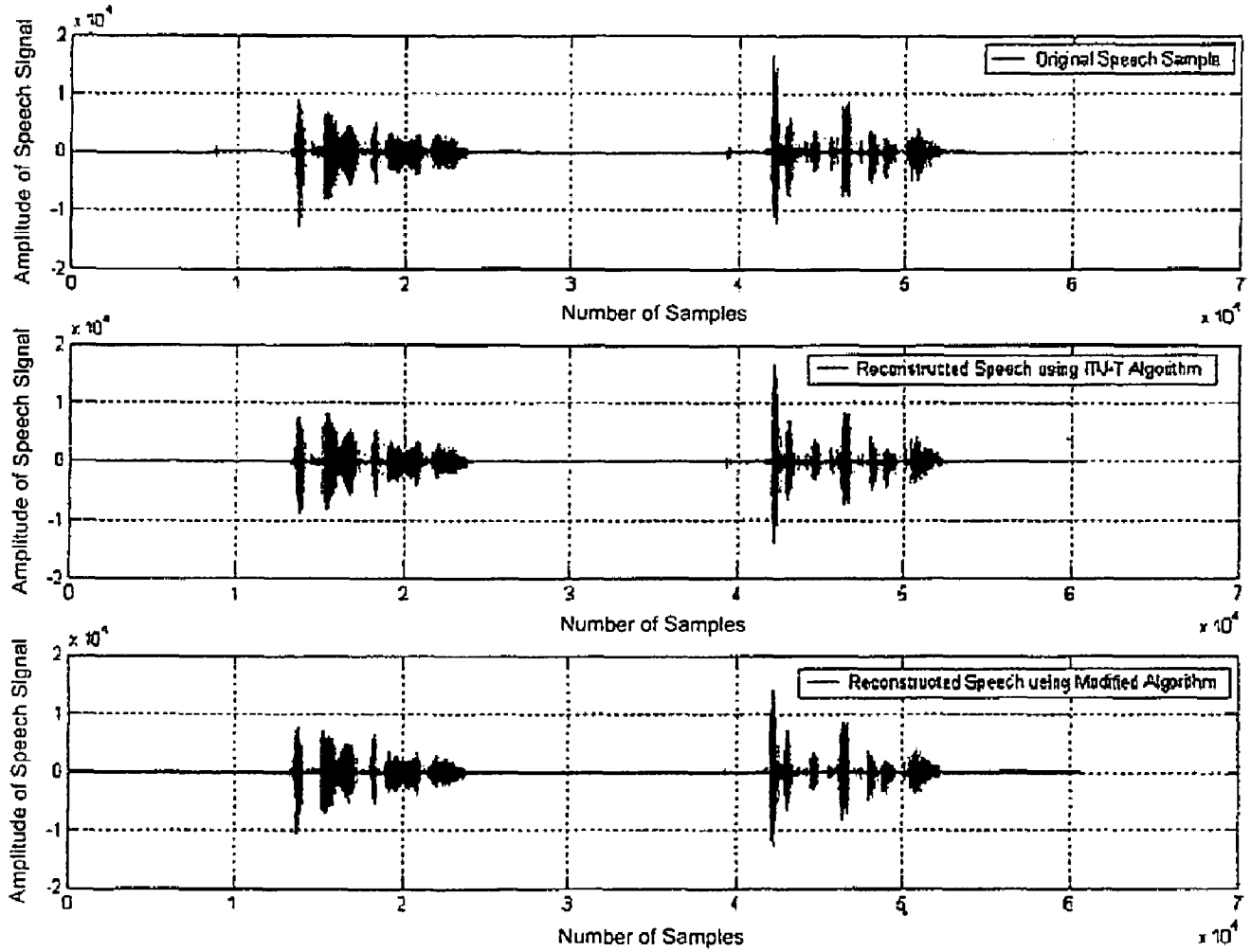
FIGS. 7A through 7C illustrate speech samples during testing of the method of FIG. 2 according to one embodiment of this disclosure.

FIGS. 7A through 7C illustrate speech samples during testing of the method of FIG. 2 according to one embodiment of this disclosure. In particular, FIG. 7A shows an original speech signal used for testing the ITU-T algorithm and the modified algorithm of FIG. 2. FIGS. 7B and 7C show reconstructed speech signals generated using the original algorithm and the modified algorithm, respectively. As can be seen, the reconstructed speech signal generated using the modified algorithm closely approximately the original signal and the reconstructed signal generated using the original algorithm.

Listening tests were also carried out for different speech test vectors by different subjects. There was generally no significant degradation in the perceived speech quality as compared to the original ITU-T algorithm. As a result, the modified algorithm, while possibly providing a slight degradation in speech quality, results in savings of more than 50 percent in processing power over the standard algorithm.

Based on these algorithmic changes to the G.723.1 codebook search algorithm, it is possible to implement a single co-processor solution that supports codebook searches for multiple speech codecs, such as the G.723.1 (5.3 kbps) and G.729A codecs.

Figure 8:
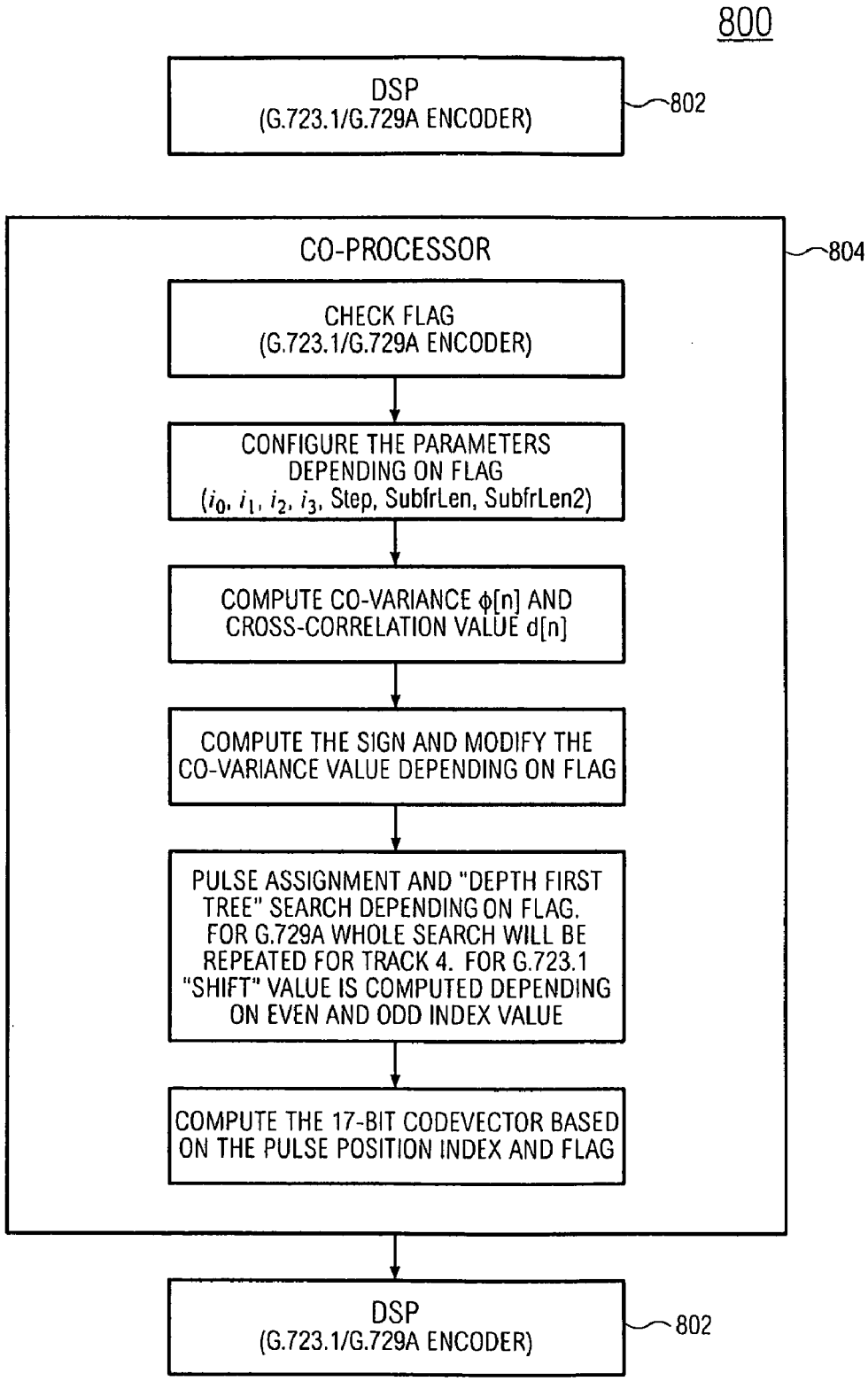
FIG. 8 illustrates a processing flow in a system supporting multiple speech codecs according to one embodiment of this disclosure.

FIG. 8 illustrates a processing flow in a system 800 supporting multiple speech codecs according to one embodiment of this disclosure. As shown in this example, the system 800 includes a DSP 802 and a co-processor 804 supporting multiple speech codecs.

A fixed codebook search may be performed twice in each frame for the G.729A speech codec, while a fixed codebook search may be performed four times in a frame for the modified G.723.1 algorithm. This may be handled in a co-processor design by varying the number of times the fixed codebook search is called by the DSP 802. Also, reconfigurable parameters of both speech codecs can be configured by the DSP 802 before the start of processing by the co-processor 804, and the DSP 802 may pass the parameters to the co-processor 804. The reconfigurable parameters may include:

Number of pulses (N)=4

Number of samples per subframe (SubFrLen)=40/60

Number of tracks=4

Number of pulse positions per track=8

Step for speech codec=5/8

Initial pulse positions (0, 2, 4, 6 or 0, 1, 2, 3).

There may be an additional reconfigurable parameter SubFrLen2 for the G.723.1 codec. The SubFrLen value may be fixed at 40 or 60. When considering track $T_2$ and track $T_3$ in the G.723.1 codec, SubFrLen2 is set at 62 to accommodate the maximum pulse position index of 60 and 62 as shown in Table 1. During a G.723.1 codebook search, pulses searched in track $T_2$ and track $T_3$ end at SubFrLen2 (i.e. 62) instead of SubFrLen (i.e. 60). As noted above, if the pulses are found at positions 60 and 62, they are not considered.

From the codebook structure for both speech codecs shown in Table 1 and Table 2, it can be seen that the G.729A codebook structure has continuous pulse positions from 0-39, while the G.723.1 (5.3 kbps) codebook structure has only even indexed pulse positions from 0-62. Odd indexed pulse position conditions are taken care of by comparing the correlation signal values $|d(n)|$ at both odd and even indexes. Depending on this comparison, a "shift" value is computed as explained above. In G.729A, there is no concept of even and odd indexed pulse positions, and it is therefore unaffected.

In the co-processor design for supporting both codecs in accordance with this disclosure, a codec flag may be implemented for identifying which codec is to be handled. The codec flag could also indicate which parameters to adopt during operation. As such, the same codec flag may be used to handle the added indexed pulses of G.723.1. During the codebook search for G.729A, the fourth pulse $i_3$ is selected from track $T_3$ or track $T_4$. The algorithm thus starts from track $T_3$, and the process is repeated by replacing track $T_3$ by track $T_4$. When considering this in co-processor 804, the same codec flag may be used to indicate the repetition of the algorithm for G.729A by replacing track $T_3$ by track $T_4$.

While maintaining compatibility with ITU-T G.723.1 and ITU-T G.729A decoders, other portions of the fixed codebook search remains the same. The other portions of the algorithm may include computing the sign of the correlation signal d(n), modifying the cross correlation values, and computing the 17-bit codebook vector.

Codebook searches for both speech codecs include computing the autocorrelation value $\phi(n)$ of the impulse response h(n) and computing the cross correlation value d(n) using the target signal r(n) and the impulse response h(n). These values may be computed before the start of a codebook search. The way these values are computed may be similar for both speech codecs, except for differences in subframe size (which is a reconfigurable parameter).

Using the new modified algorithm for the G.723.1 (5.3 kbps) fixed codebook search, a single implementation of the G.723.1 and G.729A codebook searches on the co-processor 804 can be made. Codec selection is made using the codec flag and the reconfigurable parameters, which are controlled by the DSP 802. The co-processor 804 mainly handles aspects of the fixed codebook search. The functionality of the co-processor 804 includes:

check the codec flag for G.723.1 or G.729A encoding;

configure the reconfigurable parameters depending on the codec flag;

compute the co-variance $\phi(n)$ and the cross-correlation value d(n);

compute the sign and modify the co-variance values depending on the codec flag;

perform pulse assignment and "depth-first tree search" depending on the codec flag (whole range search is repeated for track $T_3$ and $T_4$ in G.729A, and "shift" value is computed depending on even and odd index value in G.723.1); and compute the 17-bit codevector based on the pulse position indexes and flags.

Figure 9:
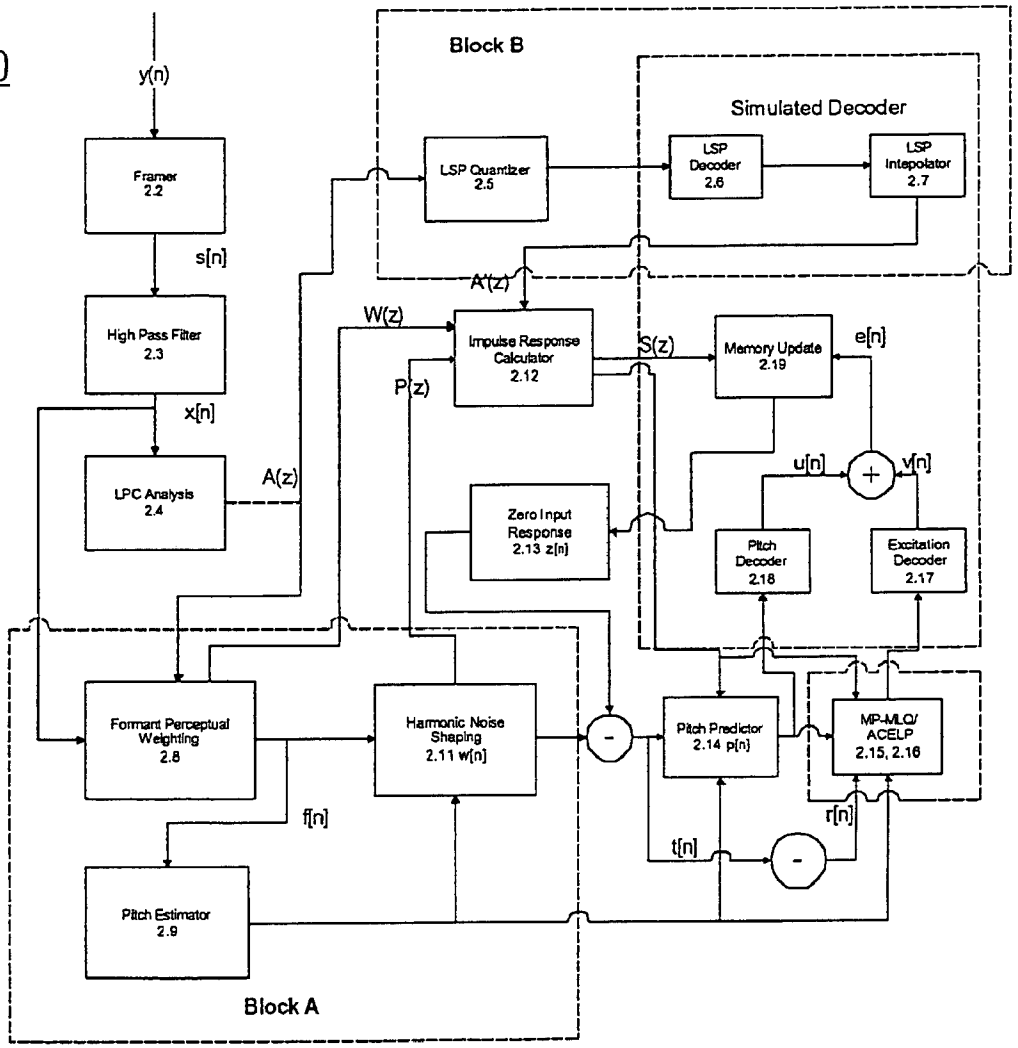
FIG. 9 illustrates an encoder supporting the G.723.1 codec according to one embodiment of this disclosure.

FIG. 9 illustrates an encoder 900 supporting the G.723.1 codec according to one embodiment of this disclosure. As shown in FIG. 9, certain modules of the encoder 900 are grouped into blocks denoted "Block A" and "Block B." The components in the two blocks may be implemented independently, meaning the blocks could be implemented or supported by different components (such as the DSP 802 and the co-processor 804) simultaneously. In particular embodiments, Block A could be implemented in the co-processor 804 via hardware, and Block B could be implemented in the DSP 802 via software.

In this example, Block A contains a pitch estimator, a Formant Perceptual Weighting filter, and a Harmonic Noise Shaping module. Block B contains Line Spectrum Pair (LSP) routines. Both Blocks A and B may be synchronized so that weighted speech W(z) and noise shaper response P(z) are available for the impulse response calculation. In this manner, processing power is reduced by about 17 percent for G.723.1 (5.3 kbps) and about 11 percent for G.723.1 (6.3 kbps).

Figure 10A:
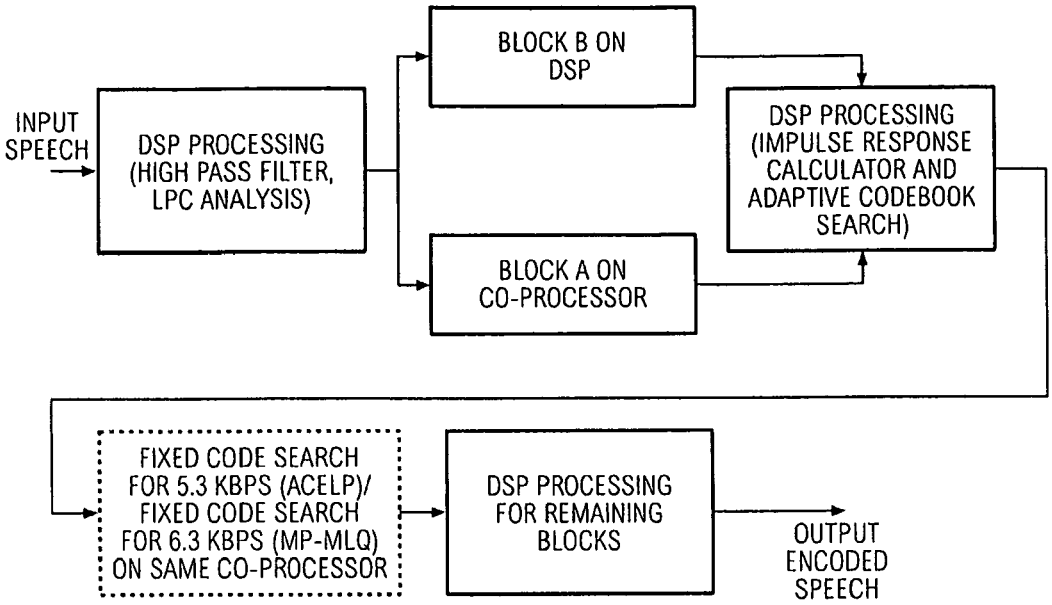
FIGS. 10A and 10B illustrate DSP and co-processor designs supporting multiple speech codecs according to one embodiment of this disclosure.
Figure 10B:
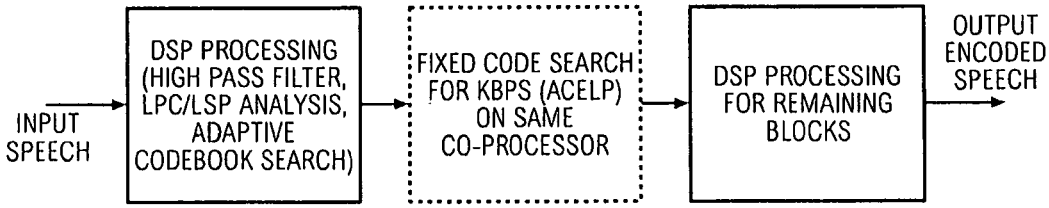

FIGS. 10A and 10B illustrate DSP and co-processor designs supporting multiple speech codecs according to one embodiment of this disclosure. In particular, FIG. 10A illustrates a configuration of the system 800 for supporting G.723.1. The DSP 802 is used for high pass filtering and LPC analysis. The co-processor 804 then takes over for the processing of Block A, while Block B continues to be processed by the DSP 802. The co-processor 804 can then perform the fixed codebook search upon completion of the Block A processing. This allows for the simultaneous processing of both Block A and Block B. It is estimated that by using this proposed design, 30-40 percent or more of the processing power may be saved.

Similarly, FIG. 10B illustrates a configuration of the system 800 for supporting G.729A. This configuration may also save up to 30 percent or more of the processing power. The DSP 802 is used for high pass filtering, LPC/LSP analysis, and adaptive codebook searches, while the co-processor 804 is used for fixed codebook searches.

In some embodiments, various functions performed in conjunction with fixed codebook searches are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory.

It may be advantageous to set forth definitions of certain words and phrases used throughout this patent document. The term "couple" and its derivatives refer to any direct or indirect communication between two or more elements, whether or not those elements are in physical contact with one another. The term "application" refers to one or more computer programs, sets of instructions, procedures, functions, objects, classes, instances, or related data adapted for implementation in a suitable computer language. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "controller" means any device, system, or part thereof that controls at least one operation. A controller may be implemented in hardware, firmware, software, or some combination of at least two of the same. The functionality associated with any particular controller may be centralized or distributed, whether locally or remotely.

While this disclosure has described certain embodiments and generally associated methods, alterations and permutations of these embodiments and methods will be apparent to those skilled in the art. For example, the above embodiments refer specifically to two codecs (G.723.1 and G.729A). It will be appreciated that various modifications and improvements can be made by a person skilled in the art without departing from the scope of this disclosure. As a particular example, other codecs having ACELP coding and substantially similar structures to the codecs described above could be used. Accordingly, the above description of example embodiments does not define or constrain this disclosure. Other changes, substitutions, and alterations are also possible without departing from the spirit and scope of this disclosure, as defined by the following claims.

What is claimed is:

1. A method for performing a search of a codebook, the codebook comprising a plurality of tracks each having a plurality of even pulse positions, the method comprising:

partitioning a codevector comprising a plurality of pulses into a first subset of pulses and a second subset of pulses, each pulse assignable to a pulse position in the codevector, each pulse associated with a shift bit for indicating an odd position;

performing a first search for determining a first set of possible pulse positions for the pulses in the codevector;

performing a second search for determining a second set of possible pulse positions for the pulses in the codevector; and forming the codevector using the first and second sets of possible pulse positions;

wherein performing the first search comprises assigning first and second pulses in the first subset and third and fourth pulses in the second subset to third, fourth, first, and second tracks of the codebook, respectively.

2. The method of claim 1, further comprising repeating the partitioning, performing, and forming steps to produce a second codevector associated with a second codebook, the second codevector comprising pulses not associated with shift bits, the second codebook comprising tracks having a plurality of odd and even pulse positions.

3. The method of claim 2, further comprising identifying one or more reconfigurable parameters, the one or more reconfigurable parameters associated with a particular one of the codebooks.

4. The method of claim 2, wherein:

the codebook comprises a G.723.1 codebook; and the second codebook comprises a G.729A codebook.

5. A method for performing a search of a codebook, the codebook comprising a plurality of tracks each having a plurality of even pulse positions, the method comprising:

partitioning a codevector comprising a plurality of pulses into a first subset of pulses and a second subset of pulses, each pulse assignable to a pulse position in the codevector, each pulse associated with a shift bit for indicating an odd position;

performing a first search for determining a first set of possible pulse positions for the pulses in the codevector, wherein performing the first search further comprises:

assigning first and second pulses in the first subset and third and fourth pulses in the second subset to third, fourth, first, and second tracks of the codebook, respectively;

determining two maximum pulse positions in the third track that are assignable to the first pulse;

testing the pulse positions in the fourth track in combination with each of the two maximum pulse positions in the third track to identify one maximum pulse position in the fourth track that is assignable to the second pulse;

determining the possible pulse positions for the first and second pulses in the first set of possible pulse positions using search criteria;

testing the pulse positions in the second track in combination with each of the pulse positions in the first track to identify pulse positions that are assignable to the third and fourth pulses; and determining the possible pulse positions for the third and fourth pulses in the first set of possible pulse positions using the search criteria performing a second search for determining a second set of possible pulse positions for the pulses in the codevector; and forming the codevector using the first and second sets of possible pulse positions.

6. The method of claim 5, wherein performing the first search further comprises:

comparing a first correlation signal value for one of the possible pulse positions in the first set of possible pulse positions with a second correlation signal value for that possible pulse position incremented by one; and shifting the possible pulse position and setting a shift bit for the possible pulse position if the second correlation signal value is higher than the first correlation signal value.

7. The method of claim 5, wherein performing the second search comprises:

determining two maximum pulse positions in the fourth track that are assignable to the first pulse;

testing the pulse positions in the first track in combination with each of the two maximum pulse positions in the fourth track to identify one maximum pulse position in the first track that is assignable to the second pulse;

determining the possible pulse positions for the first and second pulses in the second set of possible pulse positions using the search criteria;

testing the pulse positions in the third track in combination with each of the pulse positions in the second track to identify pulse positions that are assignable to the third and fourth pulses; and determining the possible pulse positions for the third and fourth pulses in the second set of possible pulse positions using the search criteria.

8. The method of claim 7, wherein performing the second search further comprises:

comparing a first correlation signal value for one of the possible pulse positions in the second set of possible pulse positions with a second correlation signal value for that possible pulse position incremented by one; and shifting the possible pulse position and setting a shift bit for the possible pulse position if the second correlation signal value is higher than the first correlation signal value.

9. A system, comprising:

a processor capable of performing functions for at least one of encoding and decoding communication signals; and a co-processor capable of performing a search of a codebook to support at least one of the encoding and decoding of the communication signals, the codebook comprising a plurality of tracks each having a plurality of even pulse positions, the co-processor capable of performing the search by:

partitioning a codevector comprising a plurality of pulses into a first subset of pulses and a second subset of pulses, each pulse assignable to a pulse position in the codevector, each pulse associated with a shift bit for indicating an odd position;

performing a first search for determining a first set of possible pulse positions for the pulses in the codevector;

performing a second search for determining a second set of possible pulse positions for the pulses in the codevector; and forming the codevector using the first and second sets of possible pulse positions;

wherein the co-processor is capable of performing the first search by assigning first and second pulses in the first subset and third and fourth pulses in the second subset to third, fourth, first, and second tracks of the codebook, respectively.

10. The system of claim 9, wherein the co-processor is further capable of repeating the partitioning, performing, and forming to produce a second codevector associated with a second codebook, the second codevector comprising pulses not associated with shift bits, the second codebook comprising tracks having a plurality of odd and even pulse positions, the codebooks associated with different codecs.

11. The system of claim 10, wherein the processor is capable of setting a codec flag to identify one of the codecs, the co-processor capable of using the codec flag to generate one of the codevectors.

12. The system of claim 11, wherein one or more reconfigurable parameters are configured by the co-processor according to the codec flag.

13. A system comprising:

a processor capable of performing functions for at least one of encoding and decoding communication signals; and a co-processor capable of performing a search of a codebook to support at least one of the encoding and decoding of the communication signals, the codebook comprising a plurality of tracks each having a plurality of even pulse positions, the co-processor capable of performing the search by:

partitioning a codevector comprising a plurality of pulses into a first subset of pulses and a second subset of pulses, each pulse assignable to a pulse position in the codevector, each pulse associated with a shift bit for indicating an odd position;

performing a first search for determining a first set of possible pulse positions for the pulses in the codevector, wherein the co-processor is capable of performing the first search by:

assigning first and second pulses in the first subset and third and fourth pulses in the second subset to third, fourth, first, and second tracks of the codebook, respectively;

determining two maximum pulse positions in the third track that are assignable to the first pulse;

testing the pulse positions in the fourth track in combination with each of the two maximum pulse positions in the third track to identify one maximum pulse position in the fourth track that is assignable to the second pulse;

determining the possible pulse positions for the first and second pulses in the first set of possible pulse positions using search criteria;

testing the pulse positions in the second track in combination with each of the pulse positions in the first track to identify pulse positions that are assignable to the third and fourth pulses; and determining the possible pulse positions for the third and fourth pulses in the first set of possible pulse positions using the search criteria;

performing a second search for determining a second set of possible pulse positions for the pulses in the codevector; and forming the codevector using the first and second sets of possible pulse positions.

14. The system of claim 13, wherein the co-processor is capable of performing the first search further by:

comparing a first correlation signal value for one of the possible pulse positions in the first set of possible pulse positions with a second correlation signal value for that possible pulse position incremented by one; and shifting the possible pulse position and setting a shift bit for the possible pulse position if the second correlation signal value is higher than the first correlation signal value.

15. The system of claim 13, wherein the co-processor is capable of performing the second search by:

determining two maximum pulse positions in the fourth track that are assignable to the first pulse;

testing the pulse positions in the first track in combination with each of the two maximum pulse positions in the fourth track to identify one maximum pulse position in the first track that is assignable to the second pulse;

determining the possible pulse positions for the first and second pulses in the second set of possible pulse positions using the search criteria;

testing the pulse positions in the third track in combination with each of the pulse positions in the second track to identify pulse positions that are assignable to the third and fourth pulses; and determining the possible pulse positions for the third and fourth pulses in the second set of possible pulse positions using the search criteria.

16. The system of claim 15, wherein the co-processor is capable of performing the second search further by:

comparing a first correlation signal value for one of the possible pulse positions in the second set of possible pulse positions with a second correlation signal value for that possible pulse position incremented by one; and shifting the possible pulse position and setting a shift bit for the possible pulse position if the second correlation signal value is higher than the first correlation signal value.

17. The system of claim 9, wherein the co-processor is further capable of implementing a pitch estimator, a Formant Perceptual Weighting filter, and a Harmonic Noise Shaping module.

18. The system of claim 9, wherein the processor comprises a digital signal processor.

19. A computer program embodied on a computer readable medium and operable to be executed by a processor, the computer program for performing a search of a codebook, the codebook comprising a plurality of tracks each having a plurality of even pulse positions, the computer program comprising computer readable program code for:

partitioning a codevector comprising a plurality of pulses into a first subset of pulses and a second subset of pulses, each pulse assignable to a pulse position in the codevector, each pulse associated with a shift bit for indicating an odd position;

performing a first search for determining a first set of possible pulse positions for the pulses in the codevector;

performing a second search for determining a second set of possible pulse positions for the pulses in the codevector;

assigning first and second pulses in the first subset and third and fourth pulses in the second subset to third, fourth, first, and second tracks of the codebook, respectively; and forming the codevector using the first and second sets of possible pulse positions.

20. The computer program of claim 19, further comprising computer readable program code for repeating the partitioning, performing, and forming steps to produce a second codevector associated with a second codebook, the second codevector comprising pulses not associated with shift bits, the second codebook comprising tracks having a plurality of odd and even pulse positions.

* * * * *

UNITED STATES PATENT AND TRADEMARK OFFICE

CERTIFICATE OF CORRECTION

PATENT NO. : 7,596,493 B2
APPLICATION NO. : 11/312005
DATED : September 29, 2009
INVENTOR(S) : Ravindra Singh and Anoop K. Krishna It is certified that error appears in the above-identified patent and that said Letters Patent is hereby corrected as shown below:

On the Title page of the patent under Item (74) "Attorney, Agent, or Firm", delete "Lisa X. Jorgenson", and replace with -- Lisa K. Jorgenson --.

Signed and Sealed this

Nineteenth Day of October, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,596,493 B2
APPLICATION NO. : 11/312005
DATED : September 29, 2009
INVENTOR(S) : Singh et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 790 days.

Signed and Sealed this

Fourteenth Day of December, 2010

David J. Kappos

David J. Kappos
*Director of the United States Patent and Trademark Office*